US006981766B2

(12) United States Patent
Tsuji

(10) Patent No.: US 6,981,766 B2
(45) Date of Patent: Jan. 3, 2006

(54) INK-JET PRINTER

(75) Inventor: Masaaki Tsuji, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 10/752,083

(22) Filed: Jan. 7, 2004

(65) Prior Publication Data

US 2004/0169712 A1 Sep. 2, 2004

(30) Foreign Application Priority Data

Jan. 10, 2003 (JP) ..... 2003-005131

(51) Int. Cl.
*B41J 11/02* (2006.01)

(52) U.S. Cl. ..... 347/104; 400/619; 226/95

(58) Field of Classification Search ..... 400/611, 400/619; 347/104; 226/95
See application file for complete search history.

(56) References Cited

U.S. PATENT DOCUMENTS 4,173,301 A * 11/1979 Turini et al. ..... 226/102
4,998,715 A * 3/1991 Milan et al. ..... 271/297
5,442,420 A * 8/1995 Tsuji ..... 355/74
5,923,942 A * 7/1999 Nuggehalli et al. ..... 399/389
6,340,155 B1 1/2002 Madsen et al.

FOREIGN PATENT DOCUMENTS

EP 1 120 266 A 8/2001
EP 1 223 042 A 7/2002

* cited by examiner

*Primary Examiner*—Andrew H. Hirshfeld
*Assistant Examiner*—Jill E. Culler
(74) *Attorney, Agent, or Firm*—Smith Patent Office

(57) ABSTRACT

Many holes are formed in a platen that is so disposed as to confront a printing head. A suction fan disposed under the platen generates suction force through the holes formed in the platen to thereby bring a paper into close contact with a surface of the platen. On a back surface of the platen, disposed is an airflow restriction plate formed with openings that correspond to a part of the holes in the platen. Before a leading edge of the paper arrives at the platen, the airflow restriction plate closes the holes. In association with a conveyance of the paper, the airflow restriction plate moves in a paper conveyance direction on the back surface of the platen and, at the same time, opens the closed holes sequentially from upstream in the paper conveyance direction. This can restrict inflow of air into the holes located downstream, in the paper conveyance direction, of the leading edge of the paper.

10 Claims, 13 Drawing Sheets

INK-JET PRINTER

BACKGROUND OF THE INVENTION

1. Field of the Invention

The present invention relates to an ink-jet printer that ejects ink onto a printing medium to perform printing.

2. Description of Related Art

Some ink-jet printers perform printing by ejecting ink onto a paper as a printing medium from a printing head that reciprocates perpendicularly to a paper conveyance direction. It is important, from the viewpoint of printing quality, to ensure flatness of the paper in a print region confronting the printing head. Thus, particularly when a long paper is used as the printing medium, there may be adopted an approach in which many holes are formed in a platen that supports the paper in the print region and a suction fan disposed under the platen generates suction force through the holes to thereby bring the paper into close contact with a surface of the platen. The holes formed in the platen are, in general, arranged on an entire surface of the platen in a substantially uniform pattern.

In such a printer, in association with a conveyance of the paper on the platen, the paper closes the holes sequentially from upstream in the paper conveyance direction with holes disposed in an area to which the paper has not yet reached open. That is, holes disposed downstream of a downstream edge of the paper in the paper conveyance direction (hereinafter, simply referred to as "leading edge") remain open. When the suction fan drives in this condition, a large amount of air flows into the holes that remain open. Therefore, there is a problem that, when such a printer performs printing onto the vicinity of the leading edge of the paper, airflow generated by the suction force of the suction fan leads away ink that is ejected by the printing head toward the vicinity of the leading edge of the paper, to result in decreased ink-landing accuracy and thus deterioration in printing quality.

SUMMARY OF THE INVENTION

An object of the present invention is to provide an ink-jet printer capable of ensuring flatness of a printing medium and at the same time restraining decrease in ink-landing accuracy, even when, in particular, printing is performed onto the vicinity of a leading edge of the printing medium.

According to an aspect of the present invention, there is provided an ink-jet printer comprising: a conveyance mechanism that conveys a printing medium; an ink ejecting member capable of ejecting ink to the printing medium; a supporting member having plural holes formed therein and supporting the printing medium in a region confronting the ink ejecting member; a suction member capable of sucking air through the holes from a printing medium supporting side of the supporting member to an opposite side thereof; and an airflow restriction member that, in a conveyance of the printing medium on the supporting member by the conveyance mechanism, reduces at least one of an amount and a speed of air flowing into, among holes located downstream of a downstream edge of the printing medium in its conveyance direction, at least a hole closest to the edge of the printing medium.

According to the aforementioned aspect, the supporting member has holes formed therein, and the suction member generates suction force through the holes so as to bring a printing medium into close contact with a surface of the supporting member to thereby ensure flatness of the printing medium. Further, the airflow restriction member reduces at least one of an amount and a speed of air flowing into, among holes located downstream of a downstream edge, i.e., leading edge, of a printing medium in its conveyance direction, at least a hole closest to the edge of the printing medium. This can prevent airflow generated by suction force of the suction member from leading away ink that is ejected by the ink ejecting member toward the vicinity of a leading edge of a printing medium. That is, according to the aforementioned aspect, flatness of a printing medium can be ensured and at the same time decrease in ink-landing accuracy can be restrained, even when printing is performed onto the vicinity of a leading edge of a printing medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
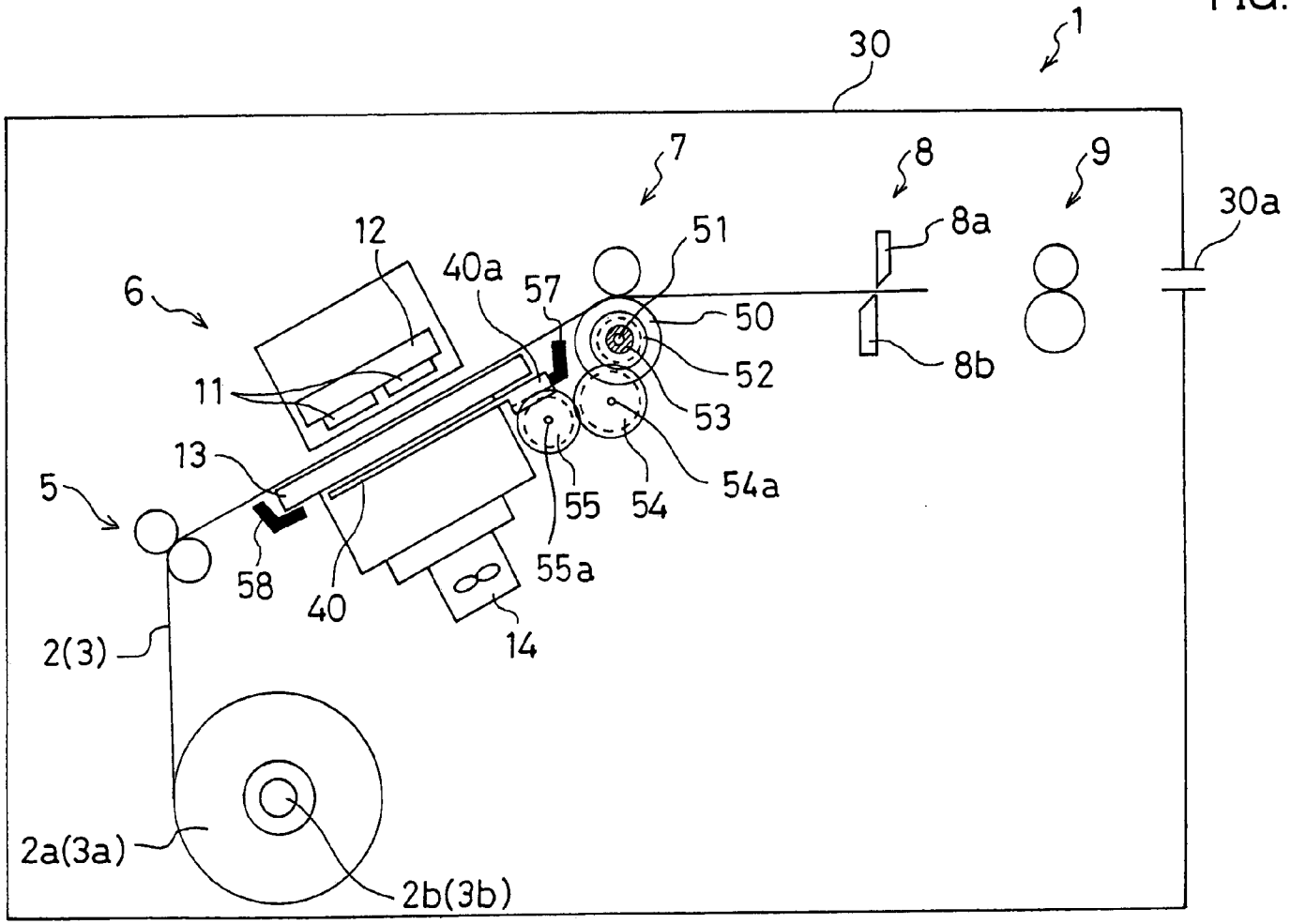
FIG. 1 schematically illustrates a construction of an ink-jet printer according to an embodiment of the present invention.

An ink-jet printer 1 illustrated in FIG. 1 has a substantially rectangular parallelepiped casing 30. The casing 30 includes therein a conveyance roller unit 5, an ink-jet printing unit 6, a press roller unit 7, a cutting unit 8, and a discharge roller unit 9 in this order from upstream in a paper conveyance direction. In the casing 30, additionally, two roll portions 2*a* and 3*a* each formed by rolling a long paper 2 or 3 as a printing medium are arranged adjacently to each other in a horizontal direction, i.e. a direction perpendicular to the drawing sheet of FIG. 1, with a predetermined distance therebetween. The roll portions 2*a* and 3*a* are supported on drums 2*b* and 3*b*, respectively, so as to rotate around their axes. The conveyance roller unit 5, the press roller unit 7, and the discharge roller unit 9 constitute a conveyance mechanism that conveys the papers 2 and 3. A controller (not illustrated) disposed within the casing 30 controls an operation of each part of the ink-jet printer 1.

Figure 2:
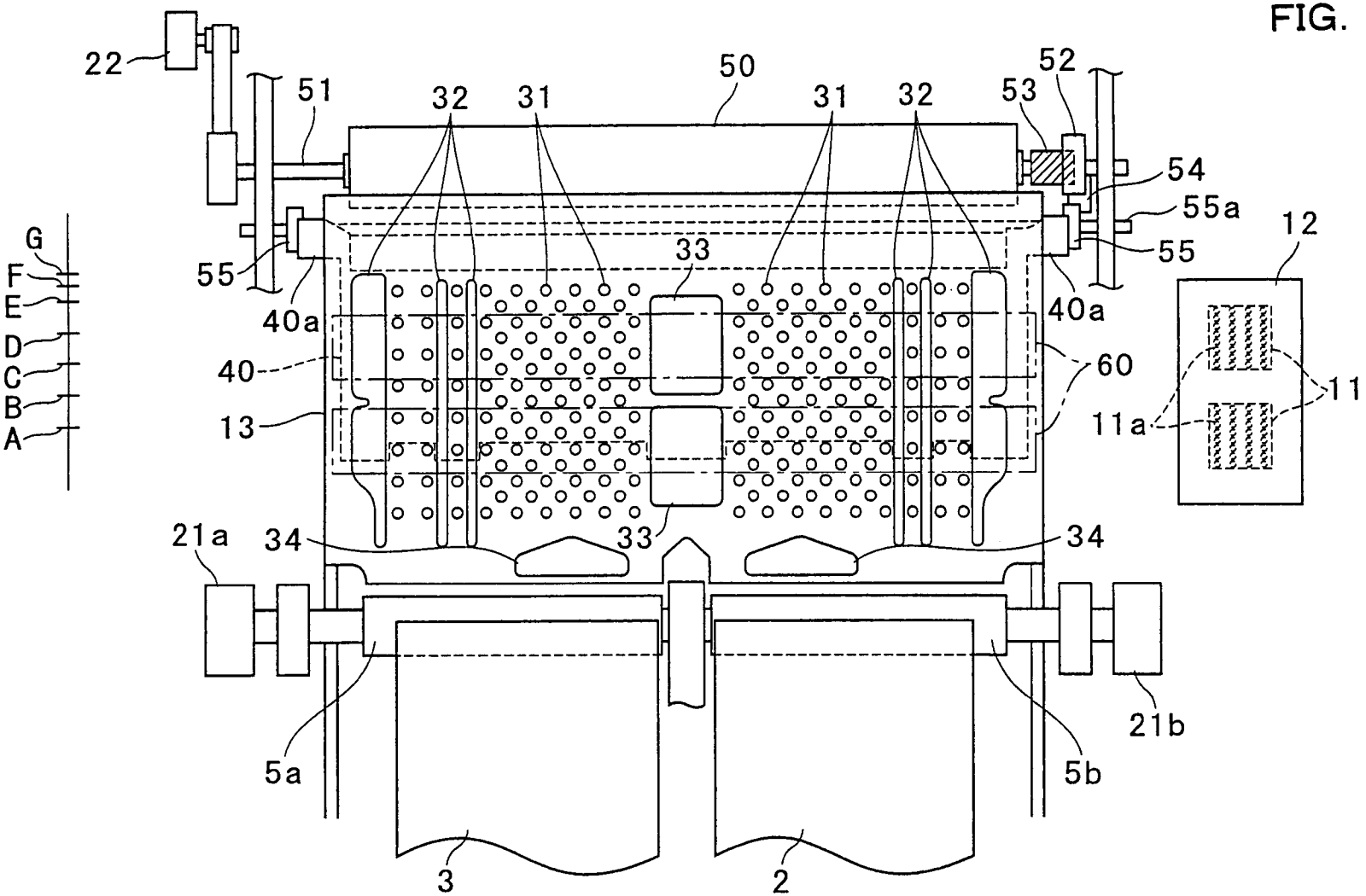
FIG. 2 is a view showing a schematic construction around a platen included in the ink-jet printer of FIG. 1.

The conveyance roller unit 5 unwinds the papers 2 and 3 from the roll portions 2*a* and 3*a* to convey them downstream in the conveyance direction, then passes the papers through the ink-jet printing unit 6, and then supplies the papers to the press roller unit 7. Further, as illustrated in FIG. 2, the conveyance roller unit 5 includes two pairs of conveyance rollers 5*a* and 5*b* that rotate by driving of motors 21*a* and 21*b* and are disposed coaxially and adjacently to each other so as to correspond to the respective papers 2 and 3 to be conveyed in parallel. The controller controls the motors 21*a* and 21*b*. The two papers 2 and 3 are independently conveyed by the corresponding pairs of conveyance rollers 5*a* and 5*b*, respectively. As illustrated in FIG. 1, each of the pairs of conveyance rollers 5*a* and 5*b* includes a drive roller disposed under a paper conveyance path and a press roller disposed over the paper conveyance path to press against the drive roller. These rollers are all disposed with their axes being perpendicular to the paper conveyance direction. Each of the two papers 2 and 3 is, as pinched with the drive roller and the press roller of each pair of conveyance rollers 5*a* or 5*b*, conveyed in accordance with rotation of the drive roller.

As illustrated in FIGS. 1 and 2, the ink-jet printing unit 6 includes two printing heads 11 each as an ink ejecting member, a carriage 12, a platen 13 as a supporting member, a suction fan 14 as a suction member, and an airflow restriction plate 40 as an airflow restriction member.

The two printing heads 11 are spaced apart from each other by a predetermined distance along the conveyance direction of the papers 2 and 3, i.e., an upward direction in FIG. 2. Each of the printing heads 11 has, on its lower face or on its face confronting the papers 2 and 3, a large number of ejection nozzles 11*a* for ejecting color inks such as yellow, magenta (purplish red), cyan (bluish green), and black. The printing heads 11 can, based on a signal from the controller, eject the color inks through the large number of ejection nozzles 11*a* onto surfaces or upper faces in FIG. 1 of the papers 2 and 3 being conveyed, to thereby print a desired color image on the papers.

The ejection nozzles 11*a* in the printing heads 11 may arbitrarily be changed in number and arrangement. The printing heads 11 may have ejection nozzles that eject plural color inks, color combination of which is other than the aforementioned, or may have a large number of ejection nozzles for only black ink to print monochrome images. The ink-jet printing unit 6 may be a piezo-jet type, a thermal-jet type, or any other types, as long as ejecting liquid ink through nozzles dot by dot to perform printing on the papers 2 and 3.

The carriage 12 holds the two printing heads 11 on its lower face such that the printing heads 11 may confront the papers. The carriage 12 is, together with the printing heads 11, reciprocatable perpendicularly to the paper conveyance direction, i.e., horizontal direction in FIG. 2. The printing heads 11 held by the carriage 12 eject ink onto the surfaces of the papers 2 and 3 while reciprocating with the carriage 12 perpendicularly to the paper conveyance direction.

The platen 13 supports the papers 2 and 3 in a region confronting the printing heads 11. A surface, an upper face in FIG. 1, of the platen 13 serves as a paper supporting side as a printing medium supporting side that is disposed on substantially the same plane as a conveyance surface for the papers 2 and 3. Thus, the printing heads 11 perform printing on the papers 2 and 3 disposed on the platen 13 while, in a state of confronting the surface of the platen 13, reciprocating along a widthwise direction of the platen 13. As illustrated in FIG. 1, the platen 13 slopes upward from upstream to downstream in the paper conveyance direction.

The printing heads 11 respectively pass over two print regions 60 (illustrated with alternate long and short dash lines in FIG. 2) on the platen 13. Each of the two print regions 60 is a band region with its length in the paper conveyance direction being equal to that of the printing head 11 and its length in the direction perpendicular to the paper conveyance direction being substantially equal to an entire width of the platen 13. The two print regions 60 are, similarly to the two printing heads 11, spaced apart from each other by a predetermined distance along the paper conveyance direction.

As illustrated in FIG. 2, the platen 13 has many holes 31, three pairs of ink receiving portions 32 arranged symmetrically with respect to a widthwise center of the platen 13, two flushing receiving portions 33 arranged at the widthwise center of the platen 13 adjacently to each other along the paper conveyance direction, and a pair of sensor openings 34 arranged on the upstream side in the paper conveyance direction symmetrically with respect to the widthwise center of the platen 13, which are formed in the platen 13.

The holes 31 are substantially circular holes all having the same size. The holes 31 are uniformly arranged in a staggered pattern in most areas of the platen 13 including the two print regions 60, an area between the two print regions 60 and areas either upstream or downstream of the print regions 60 in the paper conveyance direction.

Between the flushing receiving portions 33 and the pair of ink receiving portions 32 nearest the center of the platen 13, a plurality of first hole lines and a plurality of second hole lines are alternately arranged in the direction perpendicular to the paper conveyance direction. Each of the first hole lines is made up of eight holes 31 that form a line along the paper conveyance direction with their centers arranged at regular intervals. Each of the plurality of second hole lines is made up of seven holes 31 that form a line along the paper conveyance direction with their centers arranged at regular intervals. The holes 31 in the second hole lines are arranged intermediate between the respective holes 31 in the first hole lines that all the holes 31 have their center substantially equally spaced apart from each other. Between the ink receiving portions 32 in the platen 13, formed are the holes 31 that are the same as the eight holes 31 constituting the first hole line.

Each of the ink receiving portions 32 is an elongated recess extending across the two print regions 60 in the paper conveyance direction. The ink receiving portions 32 receive ink ejected outside widthwise edges of the papers 2 and 3 in margin-free printing. Accordingly, the each ink receiving portion 32 is formed so as to correspond to an edge, of two edges of the each paper 2 and 3 to be conveyed on the platen 13, nearer either widthwise end of the platen 13. In this embodiment, the ink receiving portions 32 are provided in three pairs so that they may cope with the papers 2 and 3 having three different width sizes. FIG. 2 illustrates that the papers 2 and 3, with their width size corresponding to the pair of ink receiving portions 32 nearest the widthwise ends of the platen 13 among the three pairs, are parallelly conveyed in two lines. An ink absorbing member (not illustrated) capable of absorbing ink is preferably arranged within each of the ink receiving portions 32. In addition, a discharge mechanism (not illustrated) for automatically discharging ink collected within the ink receiving portions 32 may be connected to the ink receiving portions 32.

The flushing receiving portions 33 are substantially rectangular openings. The flushing receiving portions 33 receive ink ejected upon a flushing operation, i.e., an operation of forcibly ejecting ink through the respective ejection nozzles 11*a* during a non-printing period, for preventing the ejection nozzles 11*a* of the printing heads 11 from being clogged. Thus, the flushing receiving portions 33 are so formed as to include the print regions 60, respectively. An ink absorbing means (not illustrated) capable of absorbing ink is preferably arranged within each of the flushing receiving portions 33. The flushing receiving portions 33 also serve as ink receiving portions for, in performing margin-free printing on the papers 2 and 3, receiving ink ejected outside the edges of the papers 2 and 3 nearer the widthwise center of the platen 13 among the both widthwise edges of the respective two papers 2 and 3.

The sensor openings 34 are so formed as to correspond to respective conveyance areas of the papers 2 and 3. A reflective photosensor (not illustrated) is disposed above the platen 13 at a position confronting the each sensor opening 34. The reflective photosensor includes a light-emitting element such as LED and a light-receiving element such as photodiode capable of receiving light emitted from the light-emitting element. The light-emitting element and the light-receiving element make a pair. The photosensor can detect the paper 2 or 3. The sensor opening 34 is formed in order that the photosensor may properly detect the paper 2 or 3.

The suction fan 14 is, as illustrated in FIG. 1, disposed at a position confronting the printing heads 11 with the conveyance paths of the papers 2 and 3 and the platen 13 sandwiched therebetween, i.e., a position on the back face side, i.e., lower face side in FIG. 1, of the papers 2 and 3. The suction fan 14 can suck air, through the holes 31, from the top face side to the back face side of the platen 13. The papers 2 and 3 having reached the ink-jet printing unit 6 are brought into close contact with the surface of the platen 13 by means of suction force of the suction fan 14, and are conveyed with a distance from the printing heads 11 fixed. This can prevent deterioration in printing quality caused by change in distance between the papers and the printing heads 11 when the papers 2 and 3 are curled to thereby partially get apart from the platen 13 to a large extent.

As illustrated in FIG. 1, the airflow restriction plate 40 (a large part thereof is illustrated with a broken line in FIG. 2) is disposed under the platen 13. The airflow restriction plate 40 is movable along the paper conveyance direction on substantially the same plane as the platen 13. As illustrated in FIG. 1, stoppers 57 and 58 are disposed downstream and upstream, in the paper conveyance direction, in a movable region of the airflow restriction plate 40. The airflow restriction plate 40 is movable between the stoppers 57 and 58. More specifically, the stopper 57 is in contact with a downstream end, in the paper conveyance direction, of the airflow restriction plate 40 when the airflow restriction plate 40 is in its most downstream position, and the stopper 58 is in contact with an upstream end of the airflow restriction plate 40, in the paper conveyance direction, when the airflow restriction plate 40 is in its most upstream position.

As seen from. FIG. 2, the airflow restriction plate 40 is a substantially rectangular plate-like member having almost the same width as that of the platen 13. A length of the airflow restriction plate 40 in the paper conveyance direction is shorter than that of the platen 13 such as to cover downstream five holes 31 in the paper conveyance direction in each of the first and second hole lines that are formed in the platen 13 along the paper conveyance direction.

Figure 3:
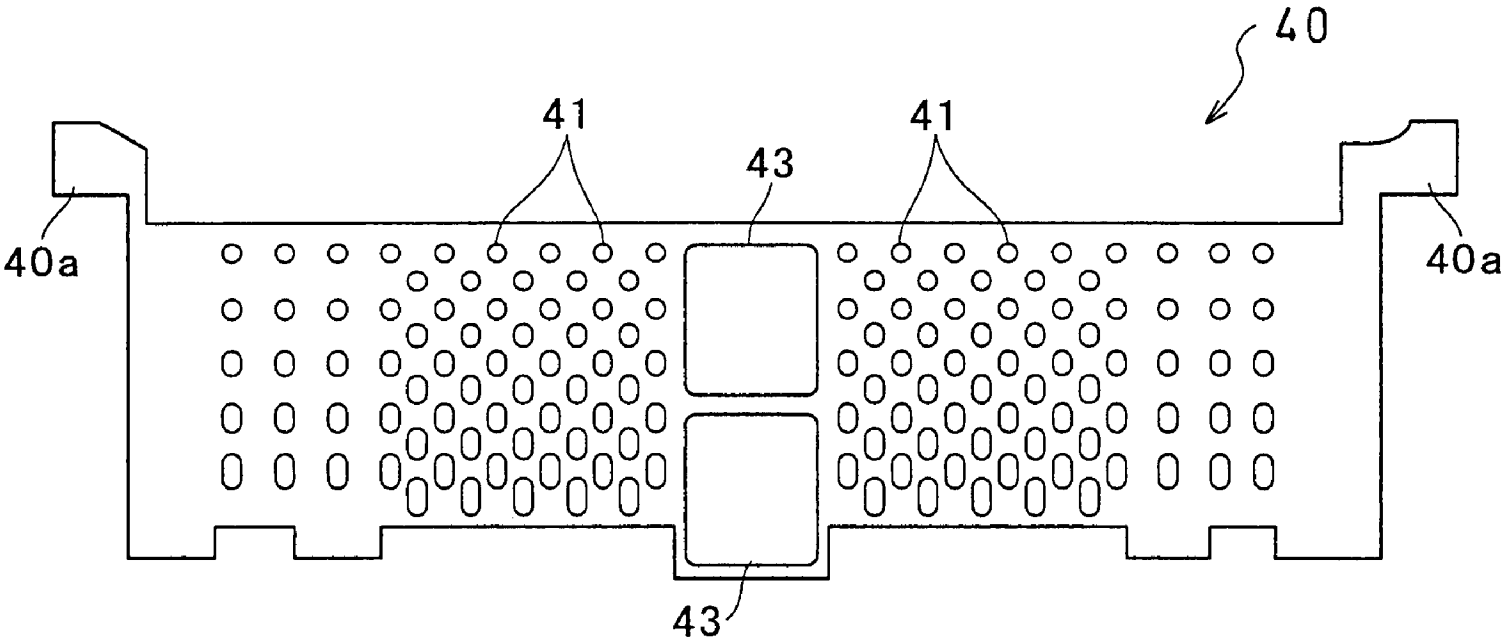
FIG. 3 is a view showing a schematic construction of an airflow restriction plate included in the ink-jet printer of FIG. 1.

As seen from FIG. 3, moreover, many openings 41 and openings 43 are formed in the airflow restriction plate 40. The openings 41 correspond to a part of the holes 31 formed in the platen 13, more specifically, to the downstream five holes 31 in the paper conveyance direction in each of the first and second hole lines. The openings 43 correspond to the flushing receiving portions 33 formed in the platen 13. The openings 41 are, similarly to the holes 31 formed in the platen 13, uniformly arranged in a staggered pattern in the airflow restriction plate 40.

In the airflow restriction plate 40, on both sides of the openings 43 that correspond to the flushing receiving portions 33, a plurality of first opening lines and a plurality of second opening lines are alternately arranged in the direction perpendicular to the paper conveyance direction. Each of the first opening lines is made up of five openings 41 that form a line along the paper conveyance direction to correspond to a part of the each first hole line in the platen 13. Each of the second opening lines is made up of five openings 41 that form a line along the paper conveyance direction to correspond to a part of the each second hole line in the platen 13. The openings 41 in the second opening lines are arranged substantially intermediate between the respective openings 41 in the first opening lines. Among the five openings 41 constituting each of the first and second opening lines, the most downstream one in the paper conveyance direction is substantially circular, and the other four are substantially oval shapes elongated in the paper conveyance direction.

The openings 41 similar to the five openings 41 constituting the first opening line are formed near both widthwise ends of the airflow restriction plate 40.

Figure 4:
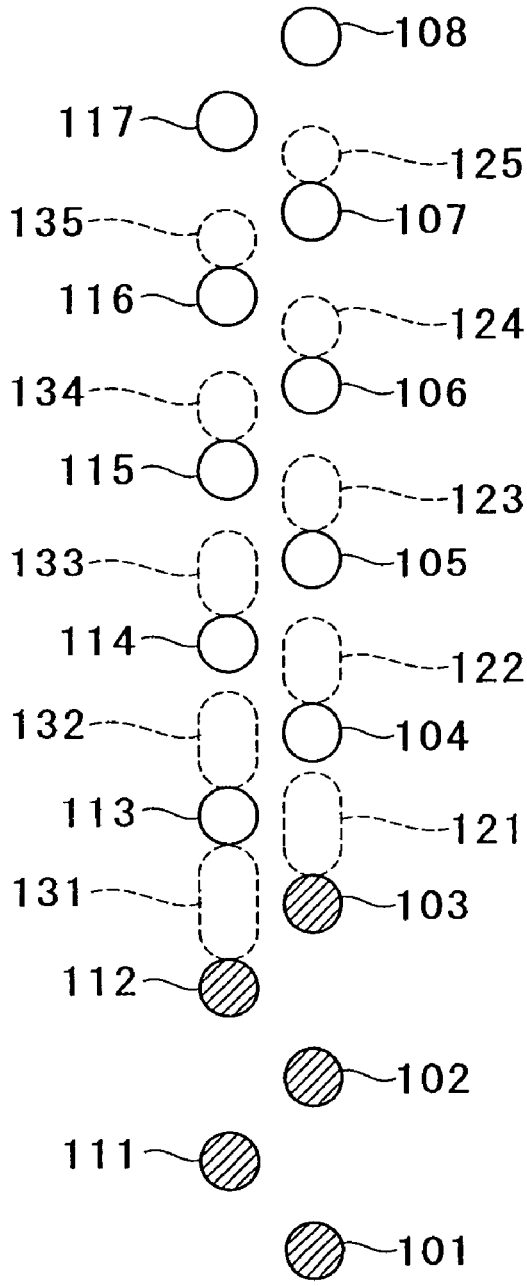
FIG. 4 is a partial view showing a state where an upstream end, in a paper conveyance direction, of the airflow restriction plate is in contact with a stopper.

Shapes of the openings included in the first and second opening lines will here be described in more detail with reference to FIG. 4. In FIG. 4, the five openings 41 constituting the first opening line are illustrated with broken lines and designated as openings 121 to 125 sequentially from upstream to downstream in the paper conveyance direction, i.e., an upward direction in FIG. 4. The five openings 41 constituting the second opening line are illustrated with broken lines and designated as openings 131 to 135 sequentially from upstream to downstream in the paper conveyance direction. In FIG. 4, moreover, the eight holes 31 constituting the first hole line formed in the platen 13 are illustrated with solid lines and designated as holes 101 to 108 sequentially from upstream to downstream in the paper conveyance direction. The seven holes 31 constituting the second hole line formed in the platen 13 are illustrated with solid lines and designated as holes 111 to 117 sequentially from upstream to downstream in the paper conveyance direction.

Referring to FIG. 4, the most downstream openings 125 and 135 in the paper conveyance direction are substantially circular holes having almost the same size as that of the holes 101 to 108 and 111 to 117. As mentioned above, all the other openings 121 to 124 and 131 to 134 are substantially oval shapes elongated in the paper conveyance direction, so that areas of the openings 121 to 124 and 131 to 134 may include areas of the holes 101 to 108 and 111 to 117, respectively. Among the openings 121 to 124 constituting the first opening line, the opening 121 on the most upstream in the paper conveyance direction is longest in the paper conveyance direction. A length of the opening in the paper conveyance direction decreases in the order of openings 122, 123, and 124. Among the openings 131 to 134 constituting the second opening line, likewise, the opening 131 on the most upstream in the paper conveyance direction is longest in the paper conveyance direction. A length of the opening in the paper conveyance direction decreases in the order of openings 132, 133, and 134. The openings 121 to 125 constituting the first opening line and the openings 131 to 135 constituting the second opening line are slightly different from each other in their length in the paper conveyance direction. Each of the openings 131 to 135 constituting the second opening line has a larger length than that of the corresponding one of the openings 121 to 125 constituting the first opening line.

Shapes, sizes, and positions of the openings 121 to 125 and 131 to 135 are appropriately set such that, in association with a movement of the airflow restriction plate 40 from upstream to downstream in the paper conveyance direction, holes 104 to 108 and holes 113 to 117 may sequentially change from a closed state into an open state, as will be detailed later.

As illustrated in FIG. 1, the press roller unit 7 has a pair of press rollers comprising a roller 50 that is rotated by means of driving of a motor 22 (see FIG. 2). The press roller unit 7 pinches and conveys the paper 2 that is conveyed from the ink-jet printing unit 6 to the cutting unit 8. The press roller unit 7 is disposed between the ink-jet printing unit 6 and the cutting unit 8, so that printing by the ink-jet printing unit 6 and cutting of the paper 2 by the cutting unit 8 can properly be performed. The motor 22 (see FIG. 2) is a stepping motor and has its drive pulses controlled by the controller.

As shown in FIGS. 1 and 2, a shaft 51 is fitted into the roller 50 of the pair of press rollers in the press roller unit 7, which is disposed under the conveyance surface for the papers 2 and 3. The motor 22 rotates the shaft 51. The shaft 51 is also fitted into a gear 52 on one side of the roller 50. The gear 52 is a circular flat-plate-like member with teeth on its entire outer circumferential surface.

A friction member 53 is disposed between the shaft 51 and the gear 52. As will be detailed later, until a torque acting between the shaft 51 and the gear 52 reaches a predetermined holding torque threshold, the friction member 53 transmits rotations of one member to the other. When the torque reaches the predetermined holding torque threshold, the friction member 53 no longer transmits rotations.

As illustrated in FIGS. 1 to 3, a pair of gear portions 40*a* with back faces thereof formed with plural teeth protruding downward are provided at both widthwise ends of the airflow restriction plate 40 on the downstream side in the paper conveyance direction. Under each gear portion 40*a*, disposed is a gear 55 that is a circular flat-plate-like member with its outer circumferential surface throughout formed with teeth, as illustrated in FIGS. 1 and 2. Each gear portion 40*a* and each gear 55 are engaged with each other.

Between the gear 52 and the gear 55 disposed under one widthwise end of the airflow restriction plate 40, disposed is a gear 54 that is, similarly to the gears 52 and 55, a circular flat-plate-like member with teeth on its entire outer circumferential surface. The gear 54 is engaged with the gear 52 and with one of the pair of gears 55. The gear 54 is rotatable together with a shaft 54*a* (see FIG. 1) fitted therein around an axis of the shaft 54*a*. The pair of gears 55 is both rotatable together with a shaft 55*a* (see FIGS. 1 and 2) fitted therein around an axis of the shaft 55*a*.

When the motor 22 drives to rotate the shaft 51 in a regular direction, i.e., in such a direction as to convey the papers 2 and 3 along the paper conveyance direction, rotations of the shaft 51 is transmitted to the gear 52, the gear 54, the gears 55, and the gear portions 40*a* of the airflow restriction plate 40 in this order until a torque acting between the shaft 51 and the gear 52 reaches the predetermined holding torque threshold of the friction member 53. In association with rotations, i.e., clockwise rotations in FIG. 1, of the gears 55, the airflow restriction plate 40 with its gear portions 40*a* engaged with the gears 55 moves downstream in the paper conveyance direction. When the downstream end of the airflow restriction plate 40 in the paper conveyance direction is brought into contact with the stopper 57, a torque acting between the shaft 51 and the gear 52 reaches the predetermined holding torque threshold of the friction member 53. Then, the shaft 51 becomes slipping on the gear 52, and therefore rotations of the shaft 51 are no longer transmitted to the gear 52. Consequently, the gear 52, the gear 54, and the gears 55 stop their rotations, so that the downstream end of the airflow restriction plate 40 in the paper conveyance direction is kept in contact with the stopper 57.

When the motor 22 drives to rotate the shaft 51 in a reverse direction, i.e., in such a direction as to convey the papers 2 and 3 against the paper conveyance direction, rotations of the shaft 51 is, similarly to the case where the shaft 51 is rotated in a regular direction, transmitted to the gear 52, the gear 54, the gears 55, and the gear portions 40*a* of the airflow restriction plate 40 in this order until a torque acting between the shaft 51 and the gear 52 reaches the predetermined holding torque threshold of the friction member 53. In association with rotations of the gears 55, i.e., counterclockwise rotations in FIG. 1, the airflow restriction plate 40 with its gear portions 40*a* engaged with the gears 55 moves upstream in the paper conveyance direction. When the upstream end of the airflow restriction plate 40 in the paper conveyance direction is brought into contact with the stopper 58, a torque acting between the shaft 51 and the gear 52 reaches the predetermined holding torque threshold of the friction member 53. Then, the shaft 51 becomes slipping on the gear 52, and therefore rotations of the shaft 51 are no longer transmitted to the gear 52. Consequently, the gear 52, the gear 54, and the gears 55 stop their rotations, so that the upstream end of the airflow restriction plate 40 in the paper conveyance direction is kept in contact with the stopper 58.

The cutting unit 8 has a movable cutting blade 8*a* disposed on the same side of the papers 2 and 3 as the printing heads 11, and a fixed cutting blade 8*b* disposed on the opposite side of the papers 2 and 3 to the movable cutting blade 8*a*. Each of the movable cutting blade 8*a* and the fixed cutting blade 8*b* is a rectangular-shaped blade having a width extending over the two papers 2 and 3 in order to cut, at one time, the two papers 2 and 3 arranged in parallel. The controller controls the movable cutting blade 8*a* to move it in such a direction as to approach to or separate from the fixed cutting blade 8*b*. The movable cutting blade 8*a* cooperates with the fixed cutting blade 8*b* to cut the printed papers 2 and 3, which have been conveyed to the cutting unit 8, along a widthwise direction of the papers 2 and 3. The printed papers 2 and 3 are thus cut into predetermined lengths.

The discharge roller unit 9 includes a pair of drive rollers driven by the controller, and conveys the papers 2 and 3 having cut by the cutting unit 8 to discharge them through a discharge port 30*a*.

The controller subjects an image signal supplied from a non-illustrated input interface to a predetermined process, and then supplies, to the ink-jet printing unit 6, a print signal including image data corresponding to an image to be printed. The controller also controls timings for conveying the papers 2 and 3 at the conveyance roller unit 5 and at the discharge roller unit 9, a timing for moving the carriage 12, a timing for ejecting ink from the printing heads 11, a timing for moving the airflow restriction plate 40, and a timing for cutting the papers 2 and 3 at the cutting unit 8, etc.

Next, a description will be given to operations of the respective parts of the ink-jet printer 1 when printing is performed on the papers 2 and 3.

When the ink-jet printer 1 performs printing on the papers 2 and 3, firstly the motors 21*a* and 21*b* illustrated in FIG. 2 rotate the pairs of drive rollers 5*a* and 5*b*, and the papers 2 and 3 are unwound from the roll portions 2*a* and 3*a* (see FIG. 1), respectively, and conveyed onto the platen 13. When leading edges of the papers 2 and 3 arrive at the print region 60 (see FIG. 2) in the platen 13, the printing heads 11 start reciprocating perpendicularly to the paper conveyance direction. The papers 2 and 3 are kept stopping during a reciprocation of the printing heads 11, and conveyed in the paper conveyance direction by a predetermined feeding amount when the printing heads are temporarily stopping before every forward or backward movement thereof That is, a forward or backward movement of the printing heads 11 and a conveyance of the paper 2 by the predetermined feeding amount are alternately repeated. The printing heads 11 eject ink onto the papers 2 and 3 during their reciprocations to thereby perform printing.

Here will be explained, with reference to FIGS. 5 to 13, changes in positional relationship between the holes 31 in the platen 13 and the openings 41 in the airflow restriction plate 40 in association with a movement of the leading edge of the paper 2. The same process as in the conveyance of the paper 2 is performed in conveying the other paper 3 as well, and therefore an explanation of the case is omitted.

Figure 5:
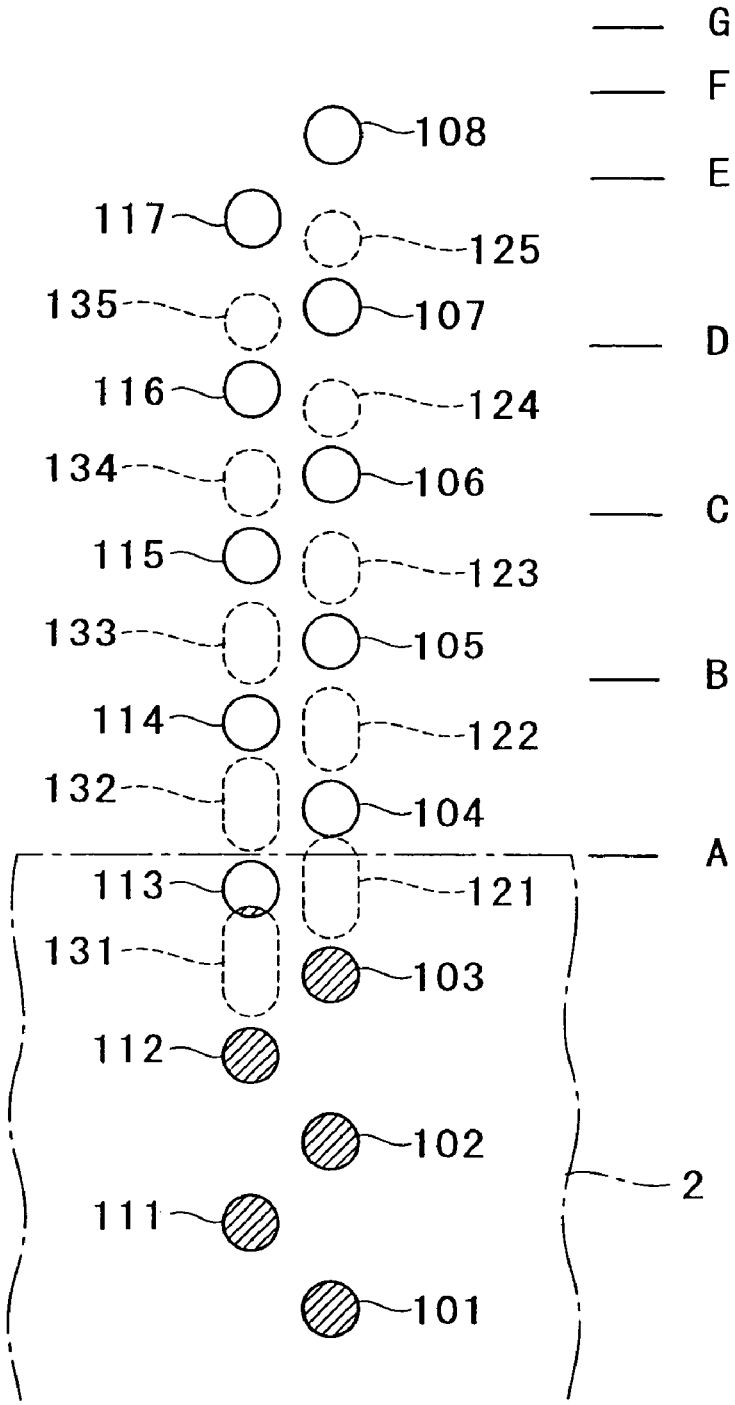
FIGS. 5 to 13 are partial views showing changes in positional relationship between holes in the platen and openings in the airflow restriction plate in association with a movement of a leading edge of a paper.
Figure 6:
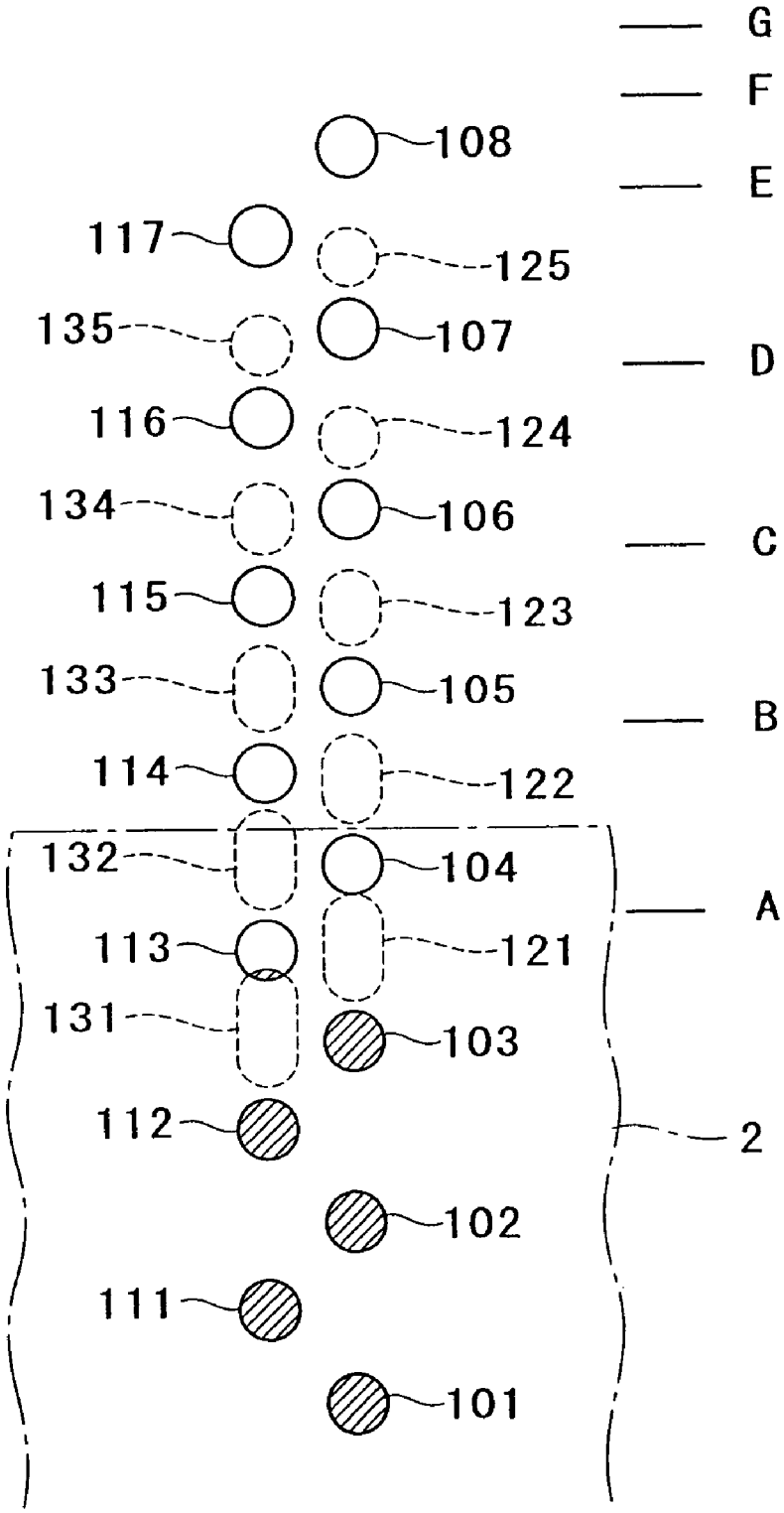
Figure 7:
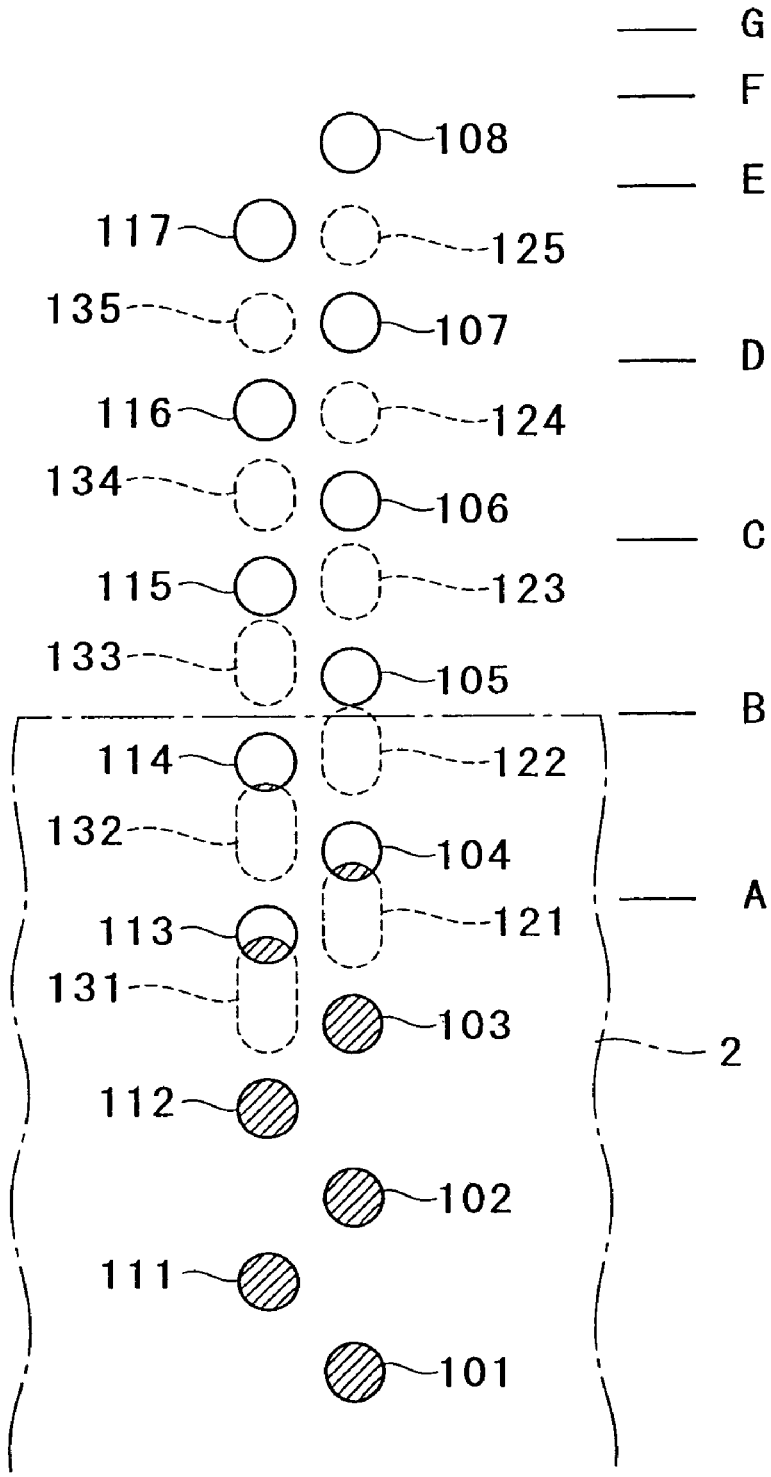
Figure 8:
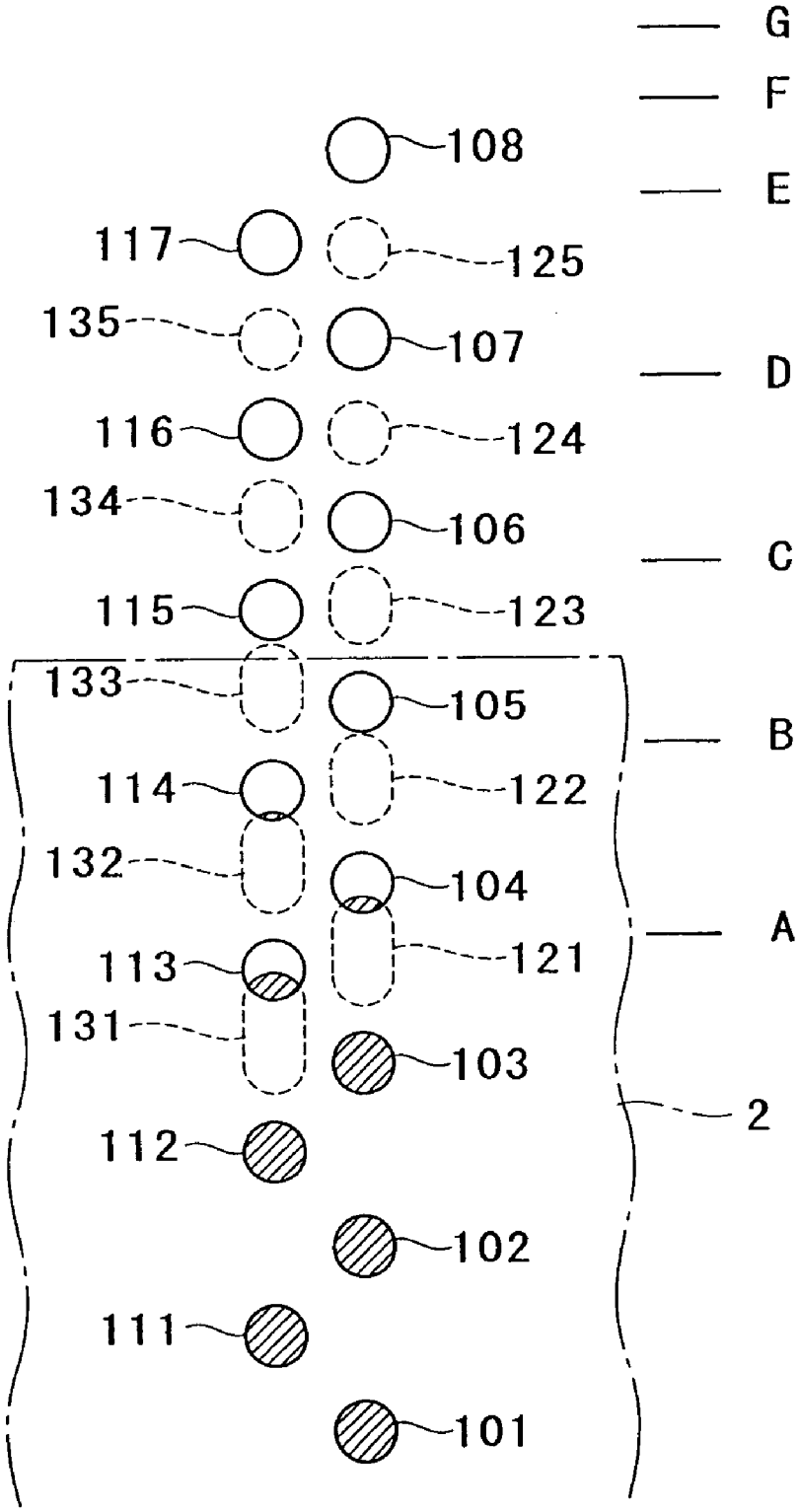

Positions A to G of the leading edge of the paper are shown in FIG. 2. FIG. 5 illustrates a case where the leading edge of the paper 2 is in the position A. FIG. 6 illustrates a case where the leading edge of the paper 2 is between the positions A and B. FIG. 7 illustrates a case where the leading edge of the paper 2 is in the position B. FIG. 8 illustrates a case where the leading edge of the paper 2 is between the positions B and C. FIGS. 9 to 13 illustrate cases where the leading edge of the paper 2 is in the positions C to G, respectively. In FIGS. 5 to 13, only one paper 2 of the papers 2 and 3 is shown. Also shown are the holes 31 in the platen 13 and the openings 41 in the airflow restriction plate 40 both formed within the conveyance area of the paper 2. The holes 31 and the openings 41 are the same as those in FIG. 4. More specifically, regarding the holes in the platen 13, only a set of first and second hole lines made up of eight holes 101 to 108 and seven holes 111 to 117, respectively, are shown. Regarding the openings in the airflow restriction plate 40, only a set of first and second opening lines made up of five openings 121 to 125 and five openings 131 to 135, respectively, are shown. The set of first and second opening lines corresponds to the set of first and second hole lines.

The end of the airflow restriction plate 40 on the upstream side in the paper conveyance direction is in contact with the stopper 58 (see FIG. 1) until the leading edge of the paper 2 reaches the position A on the platen 13. In this state, as described above with reference to FIG. 4, the holes 104 to 108 and 113 to 117 are closed, and the holes 101 to 103, 111, and 112 as patterned with oblique lines are open. A position of the airflow restriction plate 40 in this state is referred to as a first position.

When the leading edge of the paper 2 reaches the position A, the airflow restriction plate 40 moves downstream in the paper conveyance direction by a predetermined distance from the first position and then comes into a second position as shown in FIG. 5. A movement of the airflow restriction plate 40 is carried out by driving the motor 22 (see FIG. 2) of the press roller unit 7 by an amount corresponding to a predetermined number of pulses. This is because, as described above, the motor 22 drives to rotate the gear 52 as well as the shaft 51 and this rotation is transmitted to the gear 54, the gears 55, and the gear portions 40*a* of the airflow restriction plate 40 in this order.

The motor 22, which serves to rotate the roller 50 of the press roller unit 7 after the leading edge of the paper 2 arrives at the press roller unit 7, is also used to move the airflow restriction plate 40 before the leading edge of the paper 2 arrives at the press roller unit 7, that is, before the leading edge of the paper 2 becomes pinched with the pair of press rollers including the roller 50.

The airflow restriction plate 40 moves from the first position to the second position, so that the hole 113 and the opening 131 become partially overlapping each other to open the hole 113 in part. The holes 104 to 108 and 114 to 117 that are located downstream, in the paper conveyance direction, of the leading edge of the paper 2 are kept closed with the airflow restriction plate 40. The holes 101 to 103, 111, and 112 are kept open. At this time, the vicinity of the leading edge of the paper 2 is brought into close contact with the surface of the platen 13 by means of the suction force of the suction fan 14 through a part of the hole 113 in addition to the holes 101 to 103, 111, and 112.

Then, the paper 2 is conveyed with the airflow restriction plate 40 stopped in the second position. FIG. 6 illustrates a state where the leading edge of the paper 2 is between the positions A and B.

When the paper 2 is further conveyed and the leading edge thereof reaches the position B, the motor 22 of the press roller unit 7 drives again by an amount corresponding to a predetermined number of pulses. The airflow restriction plate 40 thereby moves downstream in the paper conveyance direction by a predetermined distance from the second position and then comes into a third position as shown in FIG. 7.

The airflow restriction plate 40 moves from the second position to the third position, so that the holes 104 and 114 partially overlap the openings 121 and 132, respectively, and at the same time an overlap area of the hole 113 with the opening 131 is increased. Thus, the holes 104 and 114 are partially opened to the same extent as the hole 113 illustrated in FIGS. 5 and 6. The hole 113 is, though still partially, opened larger than in FIGS. 5 and 6. The holes 105 to 108 and 115 to 117 that are located downstream, in the paper conveyance direction, of the leading edge of the paper 2 are kept closed with the airflow restriction plate 40. The holes 101 to 103, 111, and 112 are kept open. At this time, the vicinity of the leading edge of the paper 2 is brought into close contact with the surface of the platen 13 by means of the suction force of the suction fan 14 through a part of the holes 104 and 114 in addition to the holes 101 to 103, 111, 112, and a part of the hole 113.

Then the paper 2 is conveyed with the airflow restriction plate 40 stopped in the third position. FIG. 8 illustrates a state where the leading edge of the paper 2 is between the positions B and C.

When the paper 2 is further conveyed and the leading edge thereof reaches the position C, the motor 22 of the press roller unit 7 drives again by an amount corresponding to a predetermined number of pulses. The airflow restriction plate 40 thereby moves downstream in the paper conveyance direction by a predetermined distance from the third position and then comes into a fourth position as shown in FIG. 9.

The airflow restriction plate 40 moves from the third position to the fourth position, so that the holes 105 and 115 partially overlap the openings 122 and 133, respectively, and at the same time overlap areas of the holes 104, 113, and 114 with the openings 121, 131, and 132, respectively, are increased. Thus, the holes 105 and 115 are partially opened to the same extent as the holes 104 and 114 in FIGS. 7 and 8. The holes 104, 113, and 114 are, though still partially, opened larger than in FIGS. 7 and 8. The holes 106 to 108, 116 and 117 that are located downstream, in the paper conveyance direction, of the leading edge of the paper 2 are kept closed with the airflow restriction plate 40. The holes 101 to 103, 111, and 112 are kept open. At this time, the vicinity of the leading edge of the paper 2 is brought into close contact with the surface of the platen 13 by means of the suction force of the suction fan 14 through the holes 105 and 115 in addition to the holes 101 to 103, 111, 112, and a part of the holes 104, 113, and 114.

Thereafter, in the same manner as described above, every time the leading edge of the paper 2 reaches the positions D, E, F, and G, the motor 22 of the press roller unit 7 drives by an amount corresponding to a predetermined number of pulses. The airflow restriction plate 40 thereby moves downstream in the paper conveyance direction by a predetermined distance and moves from the fourth position as shown in FIG. 9 into fifth, sixth, seventh, and eighth positions as shown in FIGS. 10, 11, 12, and 13, respectively.

Figure 9:
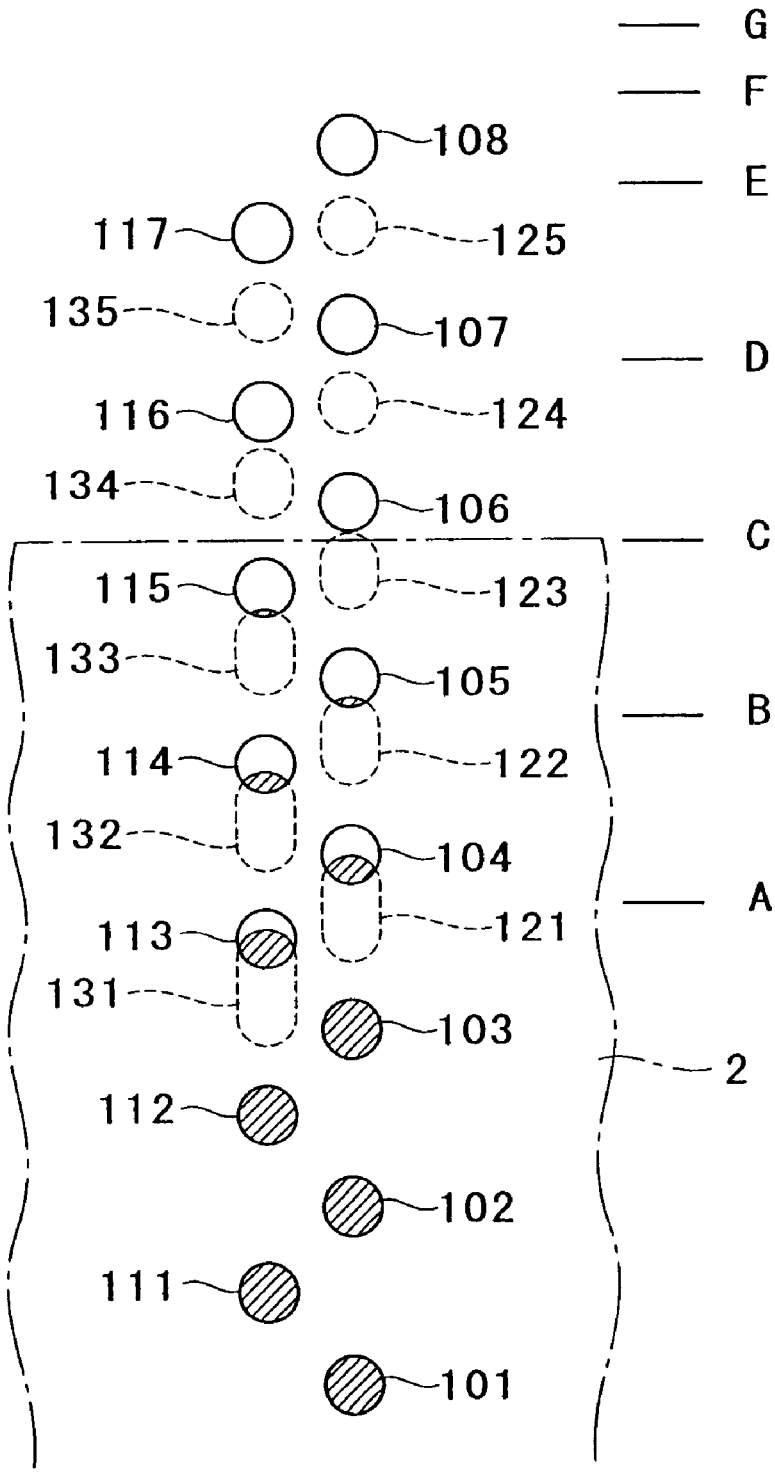
Figure 10:
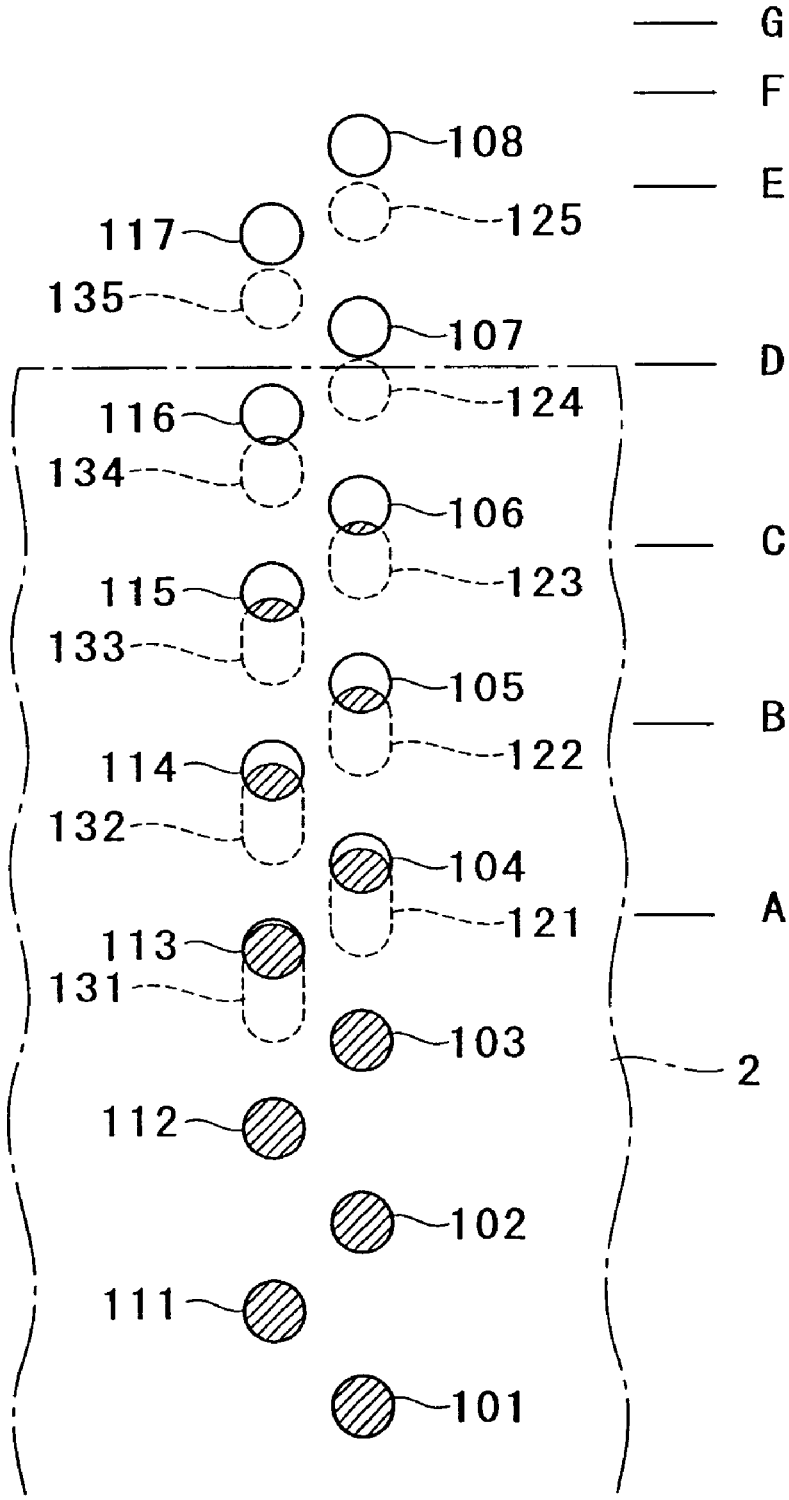
Figure 11:
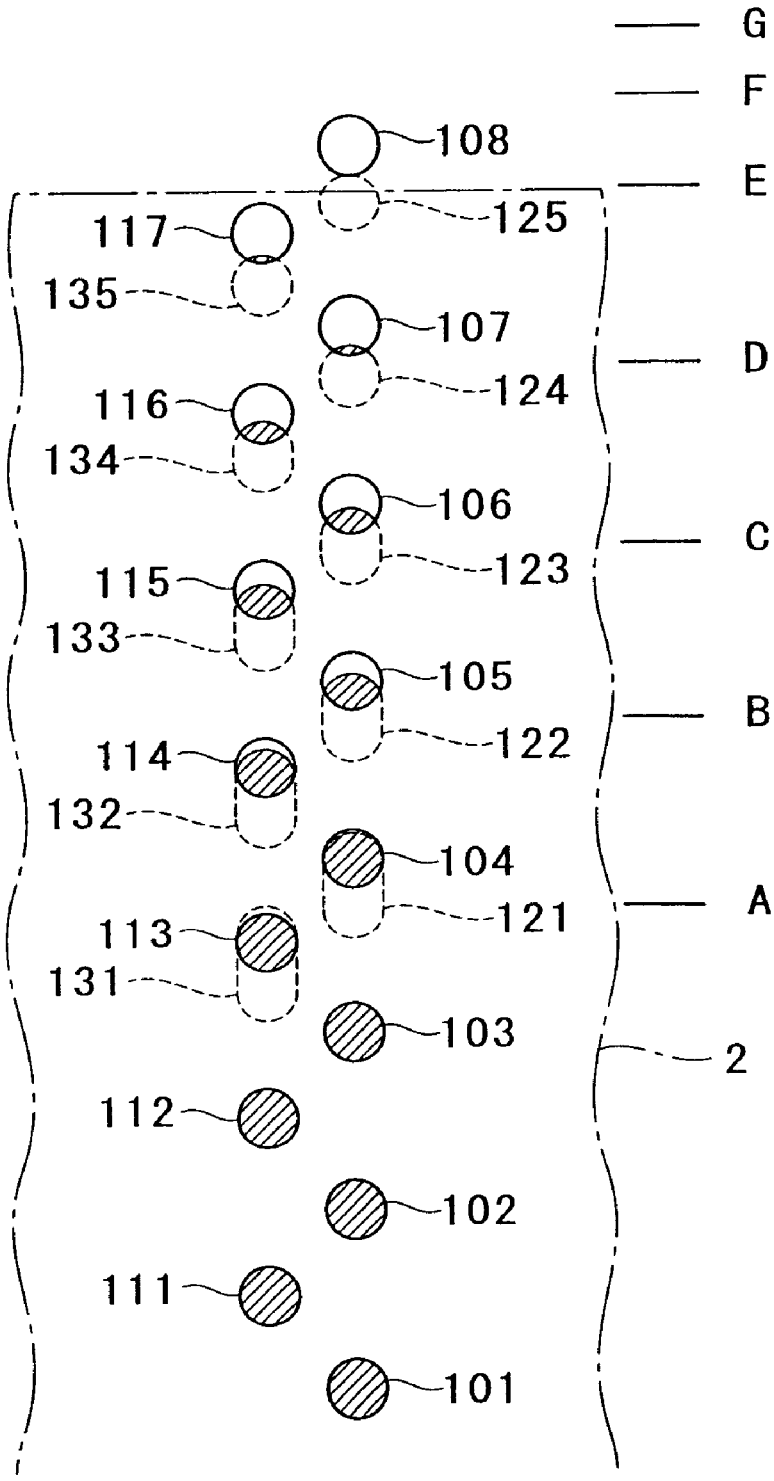
Figure 12:
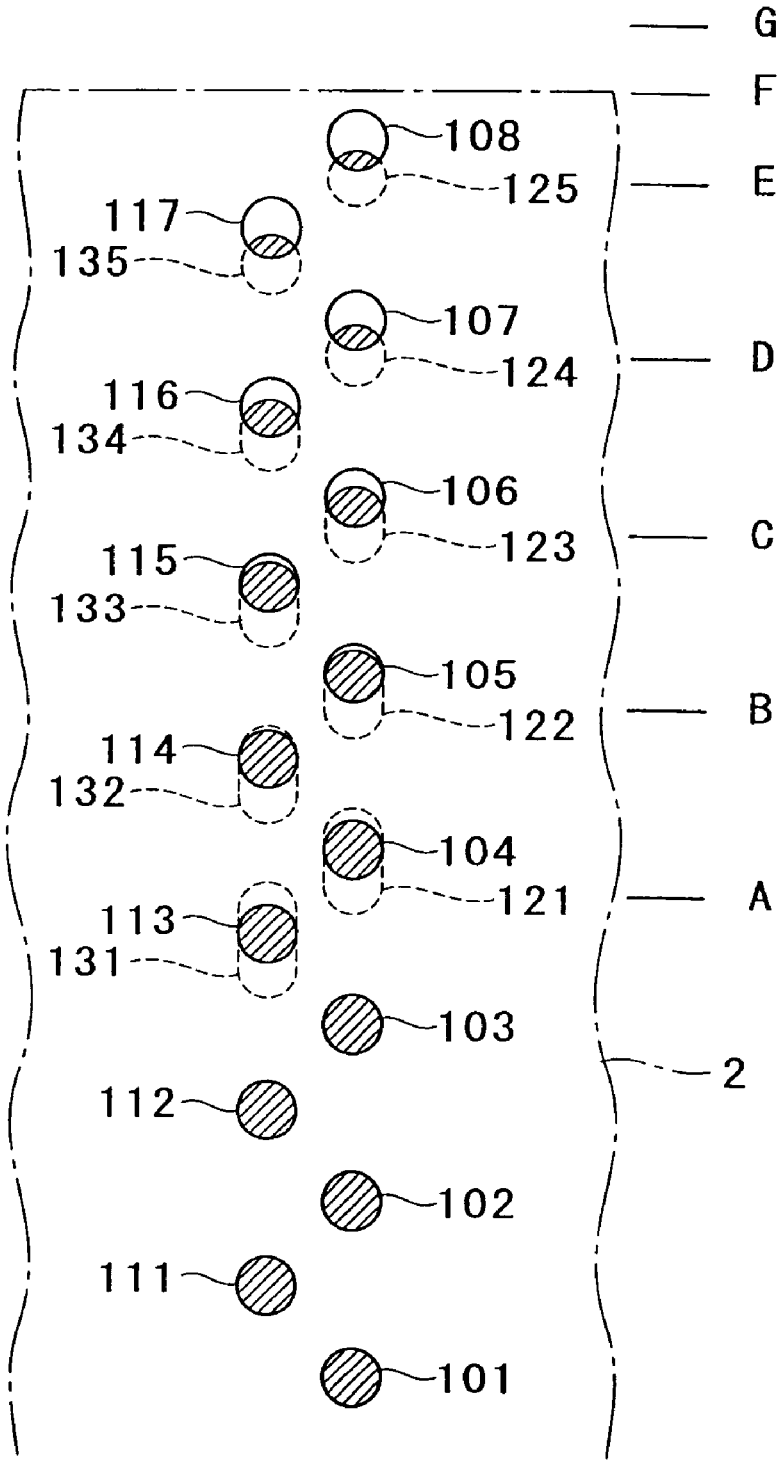
Figure 13:
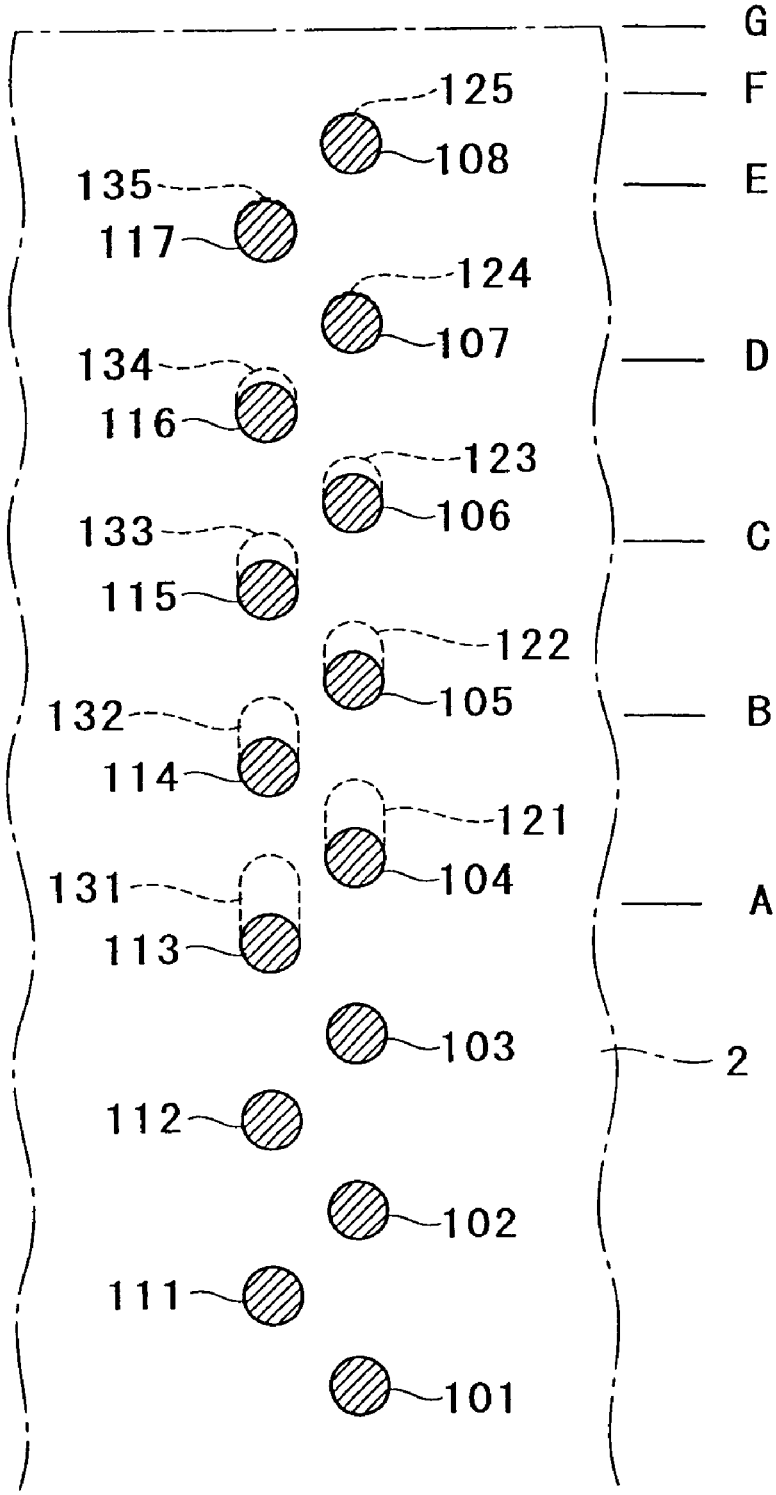

The airflow restriction plate 40 moves from the fourth position as shown in FIG. 9 into the fifth position as shown in FIG. 10, so that the holes 106 and 116 partially overlap the openings 123 and 134, respectively, and at the same time overlap areas of the holes 104, 105, 113, 114 and 115 with the openings 121, 122, 131, 132, and 133, respectively, are increased. Subsequently, the airflow restriction plate 40 moves from the fifth position as shown in FIG. 10 into the sixth position as shown in FIG. 11, so that the holes 107 and 117 partially overlap the openings 124 and 135, respectively, and at the same time overlap areas of the holes 104, 105, 106, 113, 114, 115, and 116 with the openings 121, 122, 123, 131, 132, 133, and 134, respectively, are increased. Further subsequently, the airflow restriction plate 40 moves from the sixth position as shown in FIG. 11 into the seventh position as shown in FIG. 12, so that the hole 108 partially overlaps the opening 125, and at the same time overlap areas of the holes 104, 105, 106, 107, 113, 114, 115, 116, and 117 with the openings 121, 122, 123, 124, 131, 132, 133, 134, and 135, respectively, are increased. Finally, the airflow restriction plate 40 moves from the seventh position as shown in FIG. 12 into the eighth position as shown in FIG. 13, so that the hole 108 and the opening 125, both of which are substantially circular, almost entirely overlap each other, and the hole 117 and the opening 135, both of which are substantially circular, almost entirely overlap each other. At the same time, the airflow restriction plate 40 is arranged such that the holes 104 to 107 may be within areas of the substantially oval openings 121 to 124, respectively, with an upstream end thereof, in the paper conveyance direction, aligned with each other. That is, all the holes formed in the platen 13 are opened. Thus, when the airflow restriction plate 40 is in the eighth position, the vicinity of the leading edge of the paper 2 is brought into close contact with the surface of the platen 13 by means of the suction force of the suction fan 14 through the holes 101 to 108 and 111 to 117.

As thus described, in the course of the movement of the airflow restriction plate 40 from the first to eighth positions, the holes 101 to 103, 111, and 112 are always kept open, while the holes 104 to 108 and 113 to 117 become opened sequentially from upstream in the paper conveyance direction. Then, when the leading edge of the paper 2 reaches the position G and the airflow restriction plate 40 is arranged at the eighth position, all of the holes 104 to 108 and 113 to 117 become opened (see FIG. 13).

That is, during the conveyance of the paper 2 on the platen 13, the holes located downstream, in the paper conveyance direction, of the leading edge of the paper 2 are always kept closed with the airflow restriction plate 40.

When the airflow restriction plate 40 is arranged in the eighth position, the end of the airflow restriction plate 40 on the downstream side in the paper conveyance direction is brought into contact with the stopper 57 (see FIG. 1). At this time, as described above, a torque acting between the shaft 51 and the gear 52 reaches the predetermined holding torque threshold of the friction member 53. Therefore, rotations of the shaft 51 are no longer transmitted to the gear 52. Accordingly, although the motor 22 hereafter drives for conveying the paper 2 further downstream in the paper conveyance direction, no rotation is transmitted to the gear portions 40*a* of the airflow restriction plate 40, so that the airflow restriction plate 40 is kept stopped and only the shaft 51 and the roller 50 of the press roller unit 7 with the shaft 51 fitted therein are rotated.

When printing is completed to a rear end of the long paper 2, the motor 22 drives in a direction reverse to the previous driving direction before a leading edge of a new paper is supplied onto the platen 13. The airflow restriction plate 40 thereby moves upstream in the paper conveyance direction, i.e., from the eighth position as shown in FIG. 13 to the first position as shown in FIG. 4.

As described above, according to the ink-jet printer 1, the holes 31 are formed in the platen 13, and the suction fan 14 generates suction force through the holes 31 so as to bring the papers 2 and 3 into close contact with a surface of the platen 13 to thereby ensure flatness of the papers 2 and 3. Moreover, the airflow restriction plate 40 closes the holes 31 that are located downstream of leading edges of the papers 2 and 3, to shut off inflow of air into those holes 31. This can surely prevent airflow generated by the suction force of the suction fan 14 from leading away ink that is ejected by the printing heads 11 toward the vicinity of leading edges of the papers 2 and 3. That is, according to this embodiment, even when printing is performed onto the vicinity of leading edges of the papers 2 and 3, flatness of the papers 2 and 3 can be ensured and, at the same time, decrease in ink-landing accuracy can effectively be restrained. As a result, an image with high picture quality can be printed on the vicinity of leading edges of the papers 2 and 3.

In order to solve the problem of decrease in ink-landing accuracy caused by inflow of air into the holes 31 not closed with the papers 2 and 3, it is also conceivable that the papers are in advance conveyed to such an extent that the papers may close all the holes 31 in the platen 13 before the printing heads 11 start their ink ejection operations. In this case, however, the leading edge of the paper serves only to close the holes 31 and cannot be printed thereon. This wastes a part of the paper. Particularly when the platen 13 has a large length in the paper conveyance direction, a large blank margin appears in the vicinity of the leading edge of the paper. Accordingly, a waste part of the paper without printing thereon, i.e., loss of paper, significantly increases. According to this embodiment, on the other hand, since printing can be performed onto the vicinity of a leading edge of a paper without forming a long blank margin thereat, a waste of the paper may be reduced.

In this embodiment, additionally, the airflow restriction plate 40 is adopted as an airflow restriction member for restricting inflow of air into the holes 31. The airflow restriction plate 40 confronts a surface of the platen 13 opposite to the paper supporting side thereof and, in this condition, is movable along the paper conveyance direction. In association with the movement of the leading edges of the papers 2 and 3 on the platen 13 toward downstream in the paper conveyance direction, the airflow restriction plate 40 is also moved downstream in the paper conveyance direction and, with this movement, opens the previously-closed holes 31 sequentially from upstream in the paper conveyance direction. That is, the aforementioned effects may be obtained with the airflow restriction plate 40 having such a relatively simple structure.

Moreover, the airflow restriction plate 40 has the openings 41 formed therein that correspond to a part of the many holes 31 formed in the platen 13. The openings 41 have larger lengths in the paper conveyance direction at upperstream positions in the paper conveyance direction. In this case, a movement distance of the airflow restriction plate 40 toward downstream in the paper conveyance direction for sequentially opening the holes 31 formed in the platen 13 becomes relatively small. This may restrain a printer from increasing in size.

Further, the airflow restriction plate 40 can be moved by driving force of the motor 22 that is provided basically for the purpose of driving the roller 50 of the press roller unit 7. More specifically, the driving force of the motor 22 rotates the shaft 51, and the rotations of the shaft 51 are transmitted to the gear 52, the gear 54, the gears 55, and the gear portions 40*a,* so that the airflow restriction plate 40 moves. Like this, since the motor 22 for driving the press roller unit 7 is used also as a drive source of the airflow restriction plate 40, there is no need to individually provide a drive source dedicated to the airflow restriction plate 40. Thus, a manufacturing cost of the printer may be reduced.

Still further, provided is the stopper 57 that stops the airflow restriction plate 40 from moving downstream in the paper conveyance direction beyond the position G. The press roller unit 7 conveys the papers 2 and 3 even while the airflow restriction plate 40 is being stopped by the stopper 57. More specifically, the friction member 53 is disposed between the shaft 51 and the gear 52, and, when the airflow restriction plate 40 is in contact with neither the stopper 57 nor the stopper 58, rotations of the shaft 51 are transmitted to the gear 52 to thereby move the airflow restriction plate 40. On the other hand, when the airflow restriction plate 40 is in contact with either the stopper 57 or the stopper 58, rotations of the shaft 51 are not transmitted to the gear 52, so that the airflow restriction plate 40 is kept stopping without moving and only the roller 50 of the press roller unit 7 with the shaft 51 fitted therein is rotated. Consequently, even after the airflow restriction plate 40 becomes in contact with the stopper 57, the papers 2 and 3 can properly be conveyed by the press roller unit 7.

In the aforementioned embodiment, when the papers 2 and 3 are conveyed on the platen 13, the airflow restriction plate 40 closes all the holes 31 located downstream, in the paper conveyance direction, of the leading edges of the papers 2 and 3. However, this is not limitative. For example, the effect of the restrained decrease in ink-landing accuracy can be obtained also by closing, among all the holes 31 located downstream, in the paper conveyance direction, of the leading edges of the papers 2 and 3, only the holes 31 closest to the leading edges or only the holes 31 located within the widths of the papers 2 and 3.

In addition, instead of closing the holes 31 located downstream, in the paper conveyance direction, of the leading edges of the papers 2 and 3 to thereby completely shut off airflow into those holes, air flowing into those holes may be reduced in at least one of an amount and a speed. In this case, some air flows into the holes 31 located around the leading edges of the papers 2 and 3, and this airflow into those holes 31 leads away ink that is ejected by the printing heads 11 toward the vicinity of the leading edge of the papers 2 and 3. However, this is acceptable as long as the airflow is in such a degree as to cause no decrease in ink-landing accuracy.

In the aforementioned embodiment, airflow into the holes 31 located downstream, in the paper conveyance direction, of the leading edges of the papers 2 and 3 is constantly restricted during the conveyance of the papers 2 and 3 on the platen 13. However, this is not limitative, and airflow into those holes 31 may be restricted intermittently.

The airflow restriction member is not limited to the airflow restriction plate 40 as in the aforementioned embodiment. Members having various constructions may be adopted as long as the members can restrict air flowing into the holes 31. For example, a plate member having no openings 41 shown in the aforementioned embodiment may be used as the airflow restriction member. Even though openings are to be formed, it is not always necessary that the openings have larger lengths in the paper conveyance direction at upperstream positions in the paper conveyance direction. A shape of the openings may arbitrarily be changed. Moreover, the airflow restriction member is not limited to a plate member.

Further, a shape and an arrangement of the holes 31 formed in the platen 13 are not limited to a substantial circle and a staggered pattern, respectively. The holes 31 formed in the platen 13 may arbitrarily be changed in number, size or opening area per one hole, shape, and arrangement.

Still further, although, in the aforementioned embodiment, the airflow restriction plate 40 acting as the airflow restriction member can be moved by the driving force of the motor 22 of the press roller unit 7, this is not limitative and the airflow restriction plate 40 may be moved by driving force of the motors 21*a* and 21*b* of the conveyance roller unit 5. In this case, it is necessary to provide a transmission mechanism for transmitting the driving force of the motors 21*a* and 21*b* to the airflow restriction plate 40. Alternatively, the airflow restriction plate 40 may be moved by a drive source, e.g., motor or solenoid, etc, dedicated thereto.

Still further, although the aforementioned embodiment illustrates that printing is performed onto the long papers 2 and 3 that have been unwound from the respective roll portions 2*a* and 3*a* and then conveyed, cut papers with a predetermined length may be conveyed to be printed thereon.

Still further, an application of the present invention is not limited to a so-called serial-type printer in which, as in the aforementioned embodiment, printing is performed with the printing heads 11 that reciprocate perpendicularly to the paper conveyance direction. The present invention is applicable also to a line-type printer that performs printing with a fixed printing head.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet printer comprising:

a conveyance mechanism that conveys a printing medium;

an ink ejecting member capable of ejecting ink to the printing medium;

a supporting member having plural holes formed therein and supporting the printing medium in a region confronting the ink ejecting member;

a suction member capable of sucking air through the holes from a printing medium supporting side of the supporting member to an opposite side thereof;

an airflow restriction member that moves in a conveyance direction of the printing medium and reduces at least one of an amount and a speed of air flowing into at least one hole; and means for controlling a relationship between a movement of the airflow restriction member and a movement of the printing medium so that the airflow restriction member reduces at least one of an amount and a speed of air flowing into at least the hole closest to the edge of the printing medium among holes located downstream of a downstream edge of the printing medium in the conveyance direction.

2. The ink-jet printer according to claim 1, wherein the airflow restriction member shuts off the air flowing into at least the hole closest to the edge of the printing medium among holes located downstream of a downstream edge of the printing medium in its conveyance direction.

3. The ink-jet printer according to claim 1, wherein at least the hole closest to the edge of the printing medium is disposed within a width of the printing medium.

4. The ink-jet printer according to claim 1, wherein:

the airflow restriction member is a plate member that is movable along the conveyance direction of the printing medium in a state confronting a side of the supporting member opposite to the supporting side; and in association with a movement of the edge of the printing medium on the supporting member toward downstream in the conveyance direction, the airflow restriction member moves downstream in the conveyance direction so as to open previously-closed holes sequentially from upstream in the conveyance direction.

5. The ink-jet printer according to claim 4, wherein the airflow restriction member is formed with plural openings that correspond to at least a part of the holes formed in the supporting member, and among the plural openings, an opening located upstream has a larger length in the conveyance direction.

6. The ink-jet printer according to claim 4, wherein the airflow restriction member has a portion connected to the conveyance mechanism.

7. The ink-jet printer according to claim 4, further comprising a stopper that restrains the airflow restriction member from moving downstream in the conveyance direction beyond a predetermined position, wherein the conveyance mechanism can convey the printing medium even while the airflow restriction member is being stopped by the stopper.

8. The ink-jet printer according to claim 1, wherein the airflow restriction member reduces at least one of an amount and a speed of air in a region confronting the ink ejecting member.

9. An ink-jet printer comprising:

a conveyance mechanism that conveys a printing medium;

an ink ejecting member capable of ejecting ink to the printing medium;

a supporting member having plural holes formed therein and supporting the printing medium in a region confronting the ink ejecting member;

a suction member capable of sucking air through the holes from a printing medium supporting side of the supporting member to an opposite side thereof; and an airflow restriction member having at least one hole located downstream from and closest to a downstream edge of the printing medium through which airflow is controlled so as to reduce at least one of an amount and a speed of air flowing in the at least one hole located downstream of the downstream edge of the printing medium in the conveyance direction; and means for controlling a relationship between a movement of the airflow restriction member and a movement of the printing medium so that the airflow restriction member reduces the at least one of an amount and a speed of air flowing into at least the hole closest to the edge of the printing medium among holes located downstream of a downstream edge of the printing medium in the conveyance direction.

10. An ink-jet printer comprising:

a conveyance mechanism that conveys a printing medium;

an ink ejecting member capable of ejecting ink to the printing medium;

a supporting member having plural holes formed therein and supporting the printing medium in a region confronting the ink ejecting member;

a suction member capable of sucking air through the holes from a printing medium supporting side of the supporting member to an opposite side thereof; and an airflow restriction member having at least one hole located downstream from and closest to a downstream edge of the printing medium through which airflow is controlled by a relative movement between the airflow restriction member and the supporting member so as to reduce at least one of an amount and a speed of air flowing in the at least one hole located downstream of the downstream edge of the printing medium in the conveyance direction; and means for controlling a relationship between a movement of the airflow restriction member and a movement of the printing medium so that the airflow restriction member reduces the at least one of an amount and a speed of air flowing into at least the hole closest to the edge of the printing medium among holes located downstream of a downstream edge of the printing medium in the conveyance direction.

* * * * *